United States Patent [19]

Crouzet

[11] Patent Number: 4,743,415

[45] Date of Patent: May 10, 1988

[54] PROCESS FOR SEALING RAILROAD STRUCTURES

[75] Inventor: Pierre A. Crouzet, Cully, Switzerland

[73] Assignee: Syncrete S. A., Switzerland

[21] Appl. No.: 27,904

[22] Filed: Mar. 19, 1987

[30] Foreign Application Priority Data

Mar. 22, 1986 [DE] Fed. Rep. of Germany ..... 3609825

[51] Int. Cl.[4] ..... E01B 1/00

[52] U.S. Cl. ..... 264/35; 238/2; 238/7

[58] Field of Search ..... 238/2, 6, 7; 104/6, 104/7.1, 7.2, 7.3; 264/31, 35, 261

[56] References Cited

U.S. PATENT DOCUMENTS

| | | | |
|---|---|---|---|
| 676,128 | 6/1901 | Goldie | 264/261 |
| 789,102 | 5/1905 | Nichols | 238/7 |
| 871,232 | 11/1907 | Morse | 238/7 |
| 4,204,988 | 5/1980 | Crouzet | 260/29.6 |
| 4,303,199 | 12/1981 | Eisses | 238/2 |

FOREIGN PATENT DOCUMENTS 2713950 3/1977 Fed. Rep. of Germany .

*Primary Examiner*—Jan H. Silbaugh
*Assistant Examiner*—Allan R. Kuhns
*Attorney, Agent, or Firm*—Bart G. Newland; William L. Baker

[57] ABSTRACT

A process for sealing railroad structures in which the ballast is cleared from the track, the ties are placed on blocks 3, prefabricated concrete elements 6 then being placed under each block, concrete is then poured into the spaces 7 between the prefabricated elements and finally after hardening the tracks are again lowered onto the railroad structure. This relatively simple process sequence includes the use of a synthetic concrete, preferably a synthetic microconcrete, which ensures that due to an extremely intimate connection between the prefabricated elements and the concrete in the spaces between these elements a monolithic layer is obtained.

7 Claims, 1 Drawing Sheet

PROCESS FOR SEALING RAILROAD STRUCTURES

BACKGROUND OF INVENTION

The invention relates to a process for sealing railroad structures, such as e.g. railroad bridges.

Known processes for sealing railroad structures generally comprise the following process stages:

(a) diverting railroad traffic, removing the tracks and removing the ballast materials, (b) repair of the railroad structure and application of the seal material, (c) reinstallation of the tracks and ballast materials.

The cost of measures (a) and (c) are generally 10 to 15 times those of measure (b). In addition, this process cannot be used without certain junctions being left and without the risk of cracks occurring in the materials used (e.g. cement).

OBJECTS OF THE INVENTION

Therefore it is an object of this invention to provide a new process for sealing railroad structures making it possible to enable trains to continue to travel, so that costs are much lower than in conventional repair processes.

It is a further object of this invention to use a special material for sealing the railroad structures, so that apart from the considerable cost saving, the repair work is of better quality.

These and further objects will become apparent as the description of the invention proceeds.

DETAILED DESCRIPTION OF INVENTION

Figure 1:
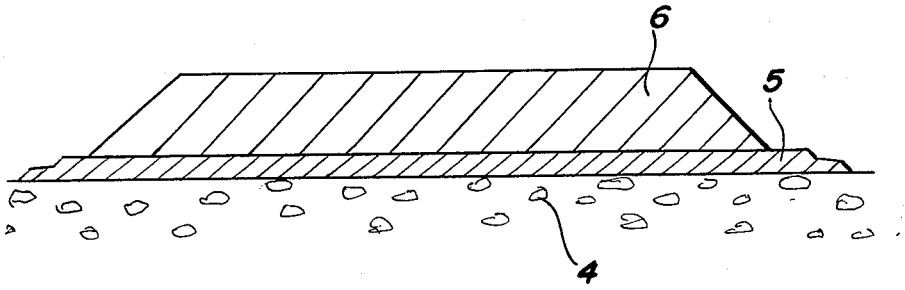

The invention is directed to a process for sealing of railroad structures as described herein and in the dependent claims.

The process according to the invention is a process for sealing of railroad structures comprising the following stages:

(a) the track is cleared of ballast and the ties are placed on blocks, (b) the railroad structure surface is prepared and cleaned, (c) each block is removed and prefabricated concrete elements are placed at the spots where the blocks were previously located and the blocks are again inserted between the prefabricated elements and the ties, (d) then the spaces between the prefabricated elements are filled by on site pouring with concrete and (e) after drying the blocks are removed and the track reballasted and levelled.

Preferably all those portions of the railroad structure, where prefabricated elements are to be positioned, and/or the surfaces of the prefabricated elements to rest on the railroad structure are coated with a binding composition making it possible to join the prefabricated elements to the substrate.

Preferably, both for the prefabricated elements and for filling the spaces between the prefabricated elements on site microconcrete (fine concrete) is used, in which sand and aggregates are relatively finely divided (sand with a particle size of less than 0.7 mm and gravel with a particle size of up to approximately 7 mm, e.g. 5 to 7 mm). The concrete used according to the invention is a product which in case of the prefabricated elements has been produced using certain emulsions, cement, sand, aggregates and catalysts, as well as optionally further conventional components or additives, and is prepared using the aforementioned ingredients when serving as binder for joining the prefabricated elements to the substrate (normally only containing sand and no aggregates) or when serving for filling the spaces between the prefabricated elements. The emulsions on which the concrete is based are water-in-resin emulsions, such as are described in U.S. Pat. No. 4,204,988 or DE-OS No. 27 13 950, the disclosure of which is herewith included by reference. These emulsions are set or hardened by mixing with binders and aggregates, as well as adding a catalyst, i.e. the binder sets in the conventional manner by hydration due to the presence of the water made available by the emulsion and simultaneously initiates the complete hardening of the resin component of the emulsion.

In more detail these emulsions useful for the purposes of the present invention are formed by mixing water with a mixture consisting essentially of an unsaturated polyester resin and an unsaturated monomer, wherein said emulsion is so stable that demulsification does not occur when a setting agents of a kind which sets by hydration thereof is added thereto. The term demulsification is used in the normal sense, i.e. the breaking of an emulsion to form two separate liquid layers, an aqueous layer and an organic layer. Thus, although the setting agent takes up water from the emulsion and, providing sufficient setting agent is present, the emulsion will eventually cease to exist, the emulsion at no stage breaks down into two separate liquid layers after the setting agent has been added thereto.

Preferably the emulsion contains from 35% to 65% by weight of water and is a water in resin emulsion. The setting agent may be an hydraulic cement, plaster of Paris, or a mixture of lime and hydraulic cement. Preferably the setting agent is a Portland cement.

The stability of the emulsion in the presence of the setting agent is influenced by the proportions of unsaturated monomer in the mixture, the ratio of reactants used in manufacturing the unsaturated polyester and the molecular weight of the reactants so used.

It has been discovered that emulsions based on unsaturated polyester/monomer mixtures comprising more than 30% by weight of unsaturated monomer based on the weight of the mixture tend to be unstable. Preferably therefore the mixture of unsaturated polyester and unsaturated monomer comprises no more than 30% by weight of the unsaturated monomer based on the weight of the mixture in case said monomer is a monovinyl monomer. Polyvinyl monomers like diallyl phthalate, triallyl cyanurate etc. or mixtures thereof with monovinyl monomers can also be used in higher proportions, e.g. 40 to 50% by weight based on the unsaturated polyester/monomer mixture.

Preferably the molar ratio of unsaturated to saturated components lies in the range from 0.8 to 1.7, and more preferably in the range from 1.35 to 1.4.

Preferably the polyhydric alcohols and the polycarboxylic acids used in manufacturing the emulsions useful for the purposes of the present invention are of high M.W., i.e. in the range from 100 to 1000, and more preferably are not polymers in their own right such as polyether polyols or polyester polyols. Suitable polyols are ethylene glycol, trimethylpentane diol and neopentyl glycol. However, a polyethylene glycol may also be used.

The total of said alcohol components is preferably in excess of 2 to 5 mole percent over stoichiometric requirements.

In forming the said polyester the condensation polymerization reaction preferably proceeds until the polyester has an acid number of 25 or less.

Preferably the unsaturated polyester or the unsaturated monomer contain substituent atoms of bromine or chlorine in order to improve the flame resistant properties. Thus tetrabromophthalic anhydride is preferably used as one of the reactants employed in manufacturing the unsaturated polyesters to be incorporated into the emulsions suitable for the purposes of the present invention.

The unsaturated monomer may be a vinyl monomer, e.g. styrene, methyl methacrylate, diallyl phthalate monomer, triallyl cyanurate monomer, or mixtures thereof.

Preferably the addition polymerization reaction is initiated by a free radical initiator. Such initiators or catalysts are well known in the art. A suitable initiator for initiation at low temperatures is e.g. dibenzoyl peroxide promoted by a copper compound. The preferred initiators are methyl ethyl ketone peroxide and butyl perbenzoate. Other suitable initiators are the organic hydroperoxides and hydrogen peroxide. It is also possible to employ free radical initiators which are activated by ultra violet light. Alternatively the addition polymerization process may be initiated by high energy irradiation.

As already mentioned above the setting agent penetrates the emulsion and is hydrated by the water, when the setting agent and initiator are added to the emulsion and mixed therewith. If the initiator employed is of the heat activated type, the heat generated by hydration of the cement activates the initiator after 10 to 15 minutes. The activated initiator then initiates an addition polymerization reaction between the unsaturated polyester and the unsaturated monomer. The heat of hydration promotes the rate of addition polymerization, resulting in rapid setting of the mixture of emulsion and setting agent.

The emulsions suitable for the purposes of the present invention may be prepared by mixing the unsaturated polyester, the unsaturated monomer and water in a high speed mixer which is able to render the dispersed phase into a particulate form with a particle size equal to, or somewhat less than, 25 microns. Preferably the unsaturated polyester resin is such that it can be emulsified with up to 60% by weight of water without demulsification occurring on the addition of the setting agent. In order to form such stable emulsions it is possible to employ small quantities of emulsifying agent, e.g. a non-ionic or anionic emulsifier but it is not necessary. In order to ensure stability of the emulsion for transportation and storage it may also be necessary to add stabilizers such as Titanium dioxide (rutile), an emulsion of a vinylic or acrylic addition polymer (1% by weight of the unsaturated polyester plus unsaturated monomer).

Thus, an essential feature of the inventive process consists of the use of prefabricated elements of a special concrete, optionally joining these prefabricated elements to the substrate using an "adhesive" from the same group and producing the seal with said same special concrete, which is also used for the prefabricated elements. This leads to an absolutely monolithic layer, which adheres completely to the old substrate (e.g. concrete, rock, steel, etc.). The intimate connection between the prefabricated elements and the on site poured or filled spaces is such that it is impossible to find even a trace of a junction on making a core. Thus, the inventive process makes it possible to apply a sealing layer to a railroad structure or repair the latter without it being necessary to interrupt traffic or remove the track.

The invention is described in greater detail hereinafter relative to the drawings, wherein show:

FIG. 1 The application of a prefabricated element to the substrate to be sealed (railroad structure).

Figure 2:
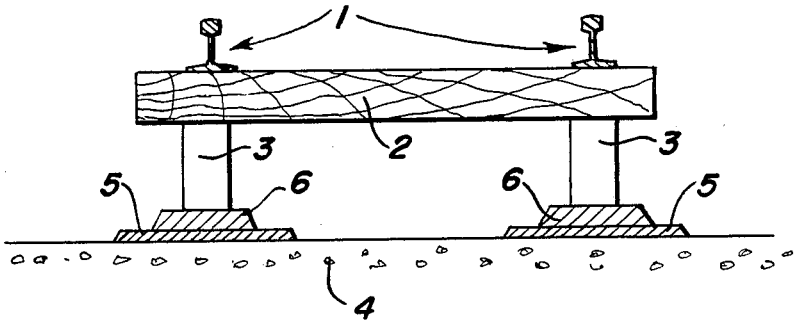

FIG. 2 The application of the prefabricated elements in detailed form.

Figure 3:
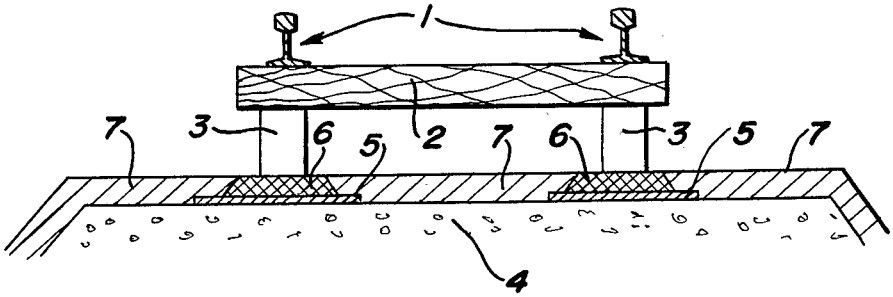

FIG. 3 A diagrammatic view of the application of the sealing layer on site.

The different process stages of the inventive process are hereinafter described in chronological order.

In the first process stage the tracks or railroad structure 1 is cleared of ballast and the ties 2 are fixed to blocks 3 having suitable dimensions, so that railroad traffic can continue to run at a reduced speed.

The second process stage is now commenced, i.e. the preparation of the surface of the railroad structure 4 in accordance with the necessary specifications for the application of the concrete used according to the invention. The railroad structure 4 is carefully cleaned for this purpose, so that the substrate is firm and free from impurities (concrete and mortar residues, traces of oil and any type of material which impairs adhesion). In order to obtain a completely firm substrate, it is necessary or recommendable to remove all brittle substrate materials, such as concrete parts of the railroad structure.

This preparation and cleaning of the railroad structure can take place in suitable manner, e.g. using pressure water, sand blasting, roughening by hand or needle machines and the like.

At the end of this preparation and cleaning stage, the third stage of the inventive process can start. In this stage the prefabricated elements are positioned in the following way:

1. The blocks 3 are removed.

2. A binding composition is prepared using an emulsion, sand (preferably with a particle size of less than 0.7 mm) and catalyst. In accordance with Example 1 of U.S. Pat. No. 4,204,988 a preferred emulsion is made by forming a mixture of the following components:

269 parts by weight Ethylene Glycol
382 parts by weight Tetrabromophthalic anhydride (MW=463.7)
224 parts by weight Maleic anhydride or fumaric acid
149 parts by weight Phthalic anhydride.

The so formed mixture is heated in a reaction vessel with continuous agitation, with a current of inert gas being swept through and over the charge. Heating is carried out as follows:

(a) initially at 170° C. for one hour,
(b) then at 185° C. for 30 minutes, and
(c) then at 190° C. for 7 hours.

The reaction of the components is terminated when an acid index under 20 is obtained and the resultant polymer is then cooled. The so obtained polyester is then blended with 290 parts by weight of monomer in the form of methyl methacrylate or a 50/50 mixture by weight of styrene and methyl methacrylate to form a mixture of unsaturated polyester and unsaturated monomer. Then this mixture is formed into an emulsion with water by e.g. mixing 500 parts by weight of the resin and 300 parts by weight of water. The mixing is preferably effected by using a high speed mixer, the mixing speed being sufficient so that all the dispersed phase is in particle form with a particle size equal to or less than 25 microns. It is important that the mixture of emulsion, sand and catalyst is completely homogeneous.

3. The portion of the railroad structure 4 where block 3 was previously located is coated with a thick layer of the binding composition 5. In other words the railroad structure is coated with the binding composition 5 at the portion where the lower surface of the prefabricated elements 6 is to be located.

4. Optionally or alternatively binding composition coating also takes place on the prefabricated element on the side which is to rest on the railroad structure 4.

5. The prefabricated element 6 is placed on the bed of binding composition 5, the coated surfaces being placed on one another. The blocks 3 are then placed on the prefabricated elements 6 and subsequently the tracks are returned onto blocks 3 (cf. FIG. 2).

After completion of the third process stage of the inventive process, it is possible to start with the filling of the spaces between the prefabricated elements 6 and the processing or finishing of the sides by on site filling with microconcrete. For this purpose the necessary concrete is worked up in a conventional cement mixer (e.g. a planet stirrer). In accordance with e.g. Example 13 of U.S. Pat. No. 4,204,988 a suitable composition can be obtained by mixing components in the proportions as follows:

803 parts by weight of an emulsion formed by mixing 500 parts by weight of the above described mixture of unsaturated polyester and unsaturated monomer, 3 parts by weight promoter in the form of Cobalt Octoate and
300 parts by weight water;
500 parts by weight of Portland cement;
5 parts by weight of Silica Flour;
3300 parts by weight of sand;
2700 parts by weight of gravel; and
5 parts by weight of catalyst in the form of Methyl Ethyl Ketone Peroxide.

The sand preferably has a particle size of less than 0.7 mm and the aggregate a particle size of up to 7 mm, so that microconcrete is obtained. As soon as a completely homogeneous mixture is obtained the microconcrete 7 is poured in a thickness corresponding to that of the prefabricated elements. This regulation can take place manually. Obviously care must be taken to ensure a good filling of the spaces between the prefabricated elements located below the ties (cf. FIG. 3).

After a sufficiently long period of time, e.g. 12 hours, the blocks 3 can be removed and the track 1 can again be provided with ballast material and levelled to the desired end profile.

As a result of the inventive procedure and the use of a special concrete material, it is possible to repair railroad structures better and cheaper than hitherto.

I claim:

1. Process for sealing of railroad structures comprising the following stages:

(a) the track is cleared of ballast material and the ties are placed on blocks.
(b) the railroad structure surface is prepared and cleaned,
(c) each block is removed and prefabricated concrete elements are placed in the spots where the blocks were placed and then the blocks are again inserted between the laid prefabricated elements and the ties,
(d) then the spaces between the prefabricated elements are filled by on site pouring with concrete and
(e) after drying the blocks are removed and the track is reballasted and levelled.

2. Process according to claim 1, wherein the railroad structure where the prefabricated elements are to be laid and/or the surface of the prefabricated elements which lie on the railroad structure are coated with a binding composition to bind the prefabricated elements to the railroad structure.

3. Process according to claim 1, wherein prefabricated elements from microconcrete are used and/or the spaces between the prefabricated elements are filled with microconcrete.

4. Process according to claim 3, wherein the microconcrete used to fill the spaces between the prefabricated elements has the same composition as the microconcrete used for the prefabricated elements.

5. Process according to claim 1, wherein the prefabricated concrete elements consist of a concrete made by using emulsions which are prepared by mixing (i) water with
(ii) a mixture consisting essentially of (a) an unsaturated polyester resin formed by a condensation polymerization reaction, which is allowed to proceed until the polyester has an acid number of no more than about 25, between polyhydric and polycarboxylic compounds or derivatives thereof, at least one of said compounds being unsaturated, the remainder being saturated; and (b) an unsaturated monomer; the mixture (ii) containing no more than about 30% by weight of the unsaturated monomer (b) provided said monomer is a monovinyl monomer;

and wherein the concrete for filling the spaces between the prefabricated elements is made by using the same emulsions used for making the concrete for the prefabricated elements.

6. Process according to claim 3, wherein the prefabricated concrete elements consist of a concrete made by using emulsions which are prepared by mixing (i) water with
(ii) a mixture consisting essentially of (a) an unsaturated polyester resin formed by a condensation polymerization reaction, which is allowed to proceed until the polyester has an acid number of no more than about 25, between polyhydric and polycarboxylic compounds or derivatives thereof, at least one of said compounds being unsaturated, the remainder being saturated; and (b) an unsaturated monomer; the mixture (ii) containing no more than about 30% by weight of the unsaturated monomer (b) provided said monomer is a monovinyl monomer;

and wherein the concrete for filling the spaces between the prefabricated elements is made by using the same emulsions used for making the concrete for the prefabricated elements.

7. Process according to claim 2, wherein the binding composition is made by using an emulsion prepared by mixing (i) water with (ii) a mixture consisting essentially of (a) an unsaturated polyester resin formed by a condensation polymerization reaction, which is allowed to proceed until the polyester has an acid number of no more than about 25, between polyhydric and polycarboxylic compounds or derivatives thereof, at least one of said compounds being unsaturated, the remainder being saturated; and (b) an unsaturated monomer; the mixture (ii) containing no more than about 30% by weight of the unsaturated monomer (b) provided said monomer is a monovinyl monomer;

and wherein the so obtained emulsion is mixed with cement, sand having a particle size of less than 0.7 mm and catalyst.

* * * * *